US005177952A

United States Patent [19]

Stone

[11] Patent Number: 5,177,952

[45] Date of Patent: Jan. 12, 1993

[54] CLOSED CYCLE POWER SYSTEM

[75] Inventor: Charles L. Stone, Corona, Calif.

[73] Assignee: Rockwell International Corporation, Seal Beach, Calif.

[21] Appl. No.: 663,219

[22] Filed: Mar. 1, 1991

[51] Int. Cl.[5] ..... F02G 3/00

[52] U.S. Cl. ..... 60/39.05; 60/39.12; 60/39.465

[58] Field of Search ..... 60/39.12, 39.511, 39.55, 60/39.05, 39.52, 39.465, 723, 731

[56] References Cited

U.S. PATENT DOCUMENTS

| | | | |
|---|---|---|---|
| 3,101,592 | 8/1963 | Robertson et al. | 60/39.12 |
| 3,229,462 | 1/1966 | Fatica | 60/39.55 |
| 3,736,745 | 6/1973 | Karig | 60/39.52 |
| 3,978,661 | 9/1976 | Cheng | 60/39.55 |
| 4,841,731 | 6/1989 | Tindell | 60/39.12 |
| 4,942,733 | 7/1990 | Hosford | 60/39.12 |

*Primary Examiner*—Michael Koczo
*Assistant Examiner*—Michael I. Kocharov
*Attorney, Agent, or Firm*—Lawrence N. Ginsberg; Charles T. Silberberg

[57] ABSTRACT

A closed cycle power system adaptable for use in terrestrial and extraterrestrial applications. A combustor is provided for combusting a fuel and an oxidizer at stoichiometric conditions. The resulting combustion efflux is combined with a third product to form a working fluid. The third product has the same atomic and molecular constituents as the fuel and oxidizer. An engine is provided for receiving the working fluid and driving power output therefrom. The exhaust from the engine is cooled and a controlled portion therefrom is extracted and condensed. The controlled portion is separated into its original atomic constituents for storage under high pressure and ultimate reuse as said fuel and oxidizer. The remaining portion of the exhaust is recompressed and reheated. That remaining portion becomes said third product which becomes combined with the comsution efflux to form a working fluid. The resulting stoichiometric closed loop process provides an efficient source of power.

16 Claims, 7 Drawing Sheets

CLOSED CYCLE POWER SYSTEM

BACKGROUND OF THE INVENTION

1. Field of the Invention

The present invention relates to power systems and more particularly to a closed cycle power system in which combustion is achieved at stoichiometric conditions.

2. Description of the Related Art

Conventional mechanical power systems such as electrical motors powered by high energy density batteries or fuel cells or dynamic isotope power systems (DIPS) have been identified for research conducted in determining Lunar and Mars surface system applications. However, these power systems are inherently limited in terms of mechanical work output capability attainable with a practical system size and weight. To perform heavy duty mechanical tasks, i.e., lunar excavation, tunneling and regolith removal for the base/-habitat construction and in-situ material processing, more advanced, intelligent and autonomously controlled machines with higher torque, horsepower and mechanical advantages must be developed.

In the course of investigating possible power systems, the present Applicant has discovered the present closed cycle power system which is the subject of the present patent application. Although developed for extraterrestrial applications, in which closed loop systems are imperative, the present invention is also particularly adaptable for applications on earth due to its environmental advantages. In this closed loop system, environmental pollutants are not released into the environment.

U.S. Pat. No. 4,112,875, entitled "Hydrogen Fuel Engine", issued to Laumann et al., discloses a hydrogen-oxygen fueled internal combustion engine which utilizes an inert gas, such as argon, as a working fluid, to increase the efficiency of the engine, eliminate pollution, and facilitate operation of a closed cycle diesel engine system. Laumann et al. do not burn in stoichiometric conditions, thus requiring the addition of the inert gas diluent. Use of a diesel engine, such as proposed by Laumann et al., is problematic because the working fluid can become contaminated by the use of different fluid and engine lubricants which can escape into the steam/inert gas efflux because of blow-by effects.

U.S. Pat. No. 4,799,357, issued to Hanrahan et al., entitled "Closed Loop Regeneration System For Generating Mechanical Energy and the Method Therefor", discloses a closed loop power regeneration system which combines chlorine and hydrogen to form hydrogen chloride at high temperatures and pressures. The high temperature, high pressure hydrogen chloride is used to drive a turbine after which the heat from the hydrogen chloride is extracted for use in a regeneration system. The hydrogen chloride is converted to hydrogen and chlorine in the regeneration system.

The Hanrahan et al. system requires elaborate chemical processes to recover the molecular hydrogen and chlorine. It requires use of an expensive reactant, silver, to extract the chlorine atom. Furthermore, hydrochloric acid and chlorine are likely to be highly corrosive agents, limiting the operating lifetime of such a system.

OBJECTS AND SUMMARY OF THE INVENTION

It is a principle object of the present invention, therefore, to provide a non-polluting, efficient closed loop power system adaptable for use in terrestrial and extraterrestrial applications.

Another object is to provide an improved system for efficiently utilizing steam as a working fluid for an internal combustion engine.

Yet another object is to combust hydrogen and oxygen in a stoichiometric manner for enhanced combustion efficiency.

These and other objects are achieved by the present invention which is a closed cycle power system. Means are provided for combusting a fuel and an oxidizer at stoichiometric conditions. The resulting combustion efflux is combined with a third product to form a working fluid. The third product has the same atomic and molecular constituents as the fuel and oxidizer. An engine is provided for receiving the working fluid and driving power output therefrom. The exhaust from the engine is cooled and a controlled portion therefrom is extracted and condensed. Separating means are provided for separating the controlled portion into its original atomic constituents for storage under high pressure and ultimate reuse as said fuel and oxidizer. The remaining portion of the exhaust is recompressed and reheated. That remaining portion becomes said third product which becomes combined with the combustion efflux to form a working fluid. The resulting stoichiometric closed loop process provides an efficient source of power.

In its more narrower aspects, the fuel and oxidizer utilized comprise $H_2$ and $O_2$, respectively. Steam becomes the working fluid and an electrolysis unit is used to separate the $H_2O$ into its original atomic and molecular constituents—$H_2$ and $O_2$.

The power system of the present invention is particularly adaptable for use with extraterrestrial applications. In such applications, the electrolysis unit may be provided power by microwave transmissions from, for example, orbiting satellites.

The closed thermodynamic cycle utilized by the present invention is a modified Brayton cycle. It is simple and uniquely characterized by the fact that all its working fluids, which undergo various physical and chemical energy state changes in the power conversion process, are collected and totally recycled. During the engine operation, the rate at which water is condensed and removed from the engine cycle is precisely controlled. Under steady state conditions at any given engine load, the amount of water removed is always equal to the sum of the hydrogen and oxygen flows being supplied to the catalytic combustor.

$H_2/O_2$ combustion at stoichiometric conditions provides the most efficient manner of producing mechanical power in which the ratio of useful engine power production to engine energy losses is maximized.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENT

Figure 1:
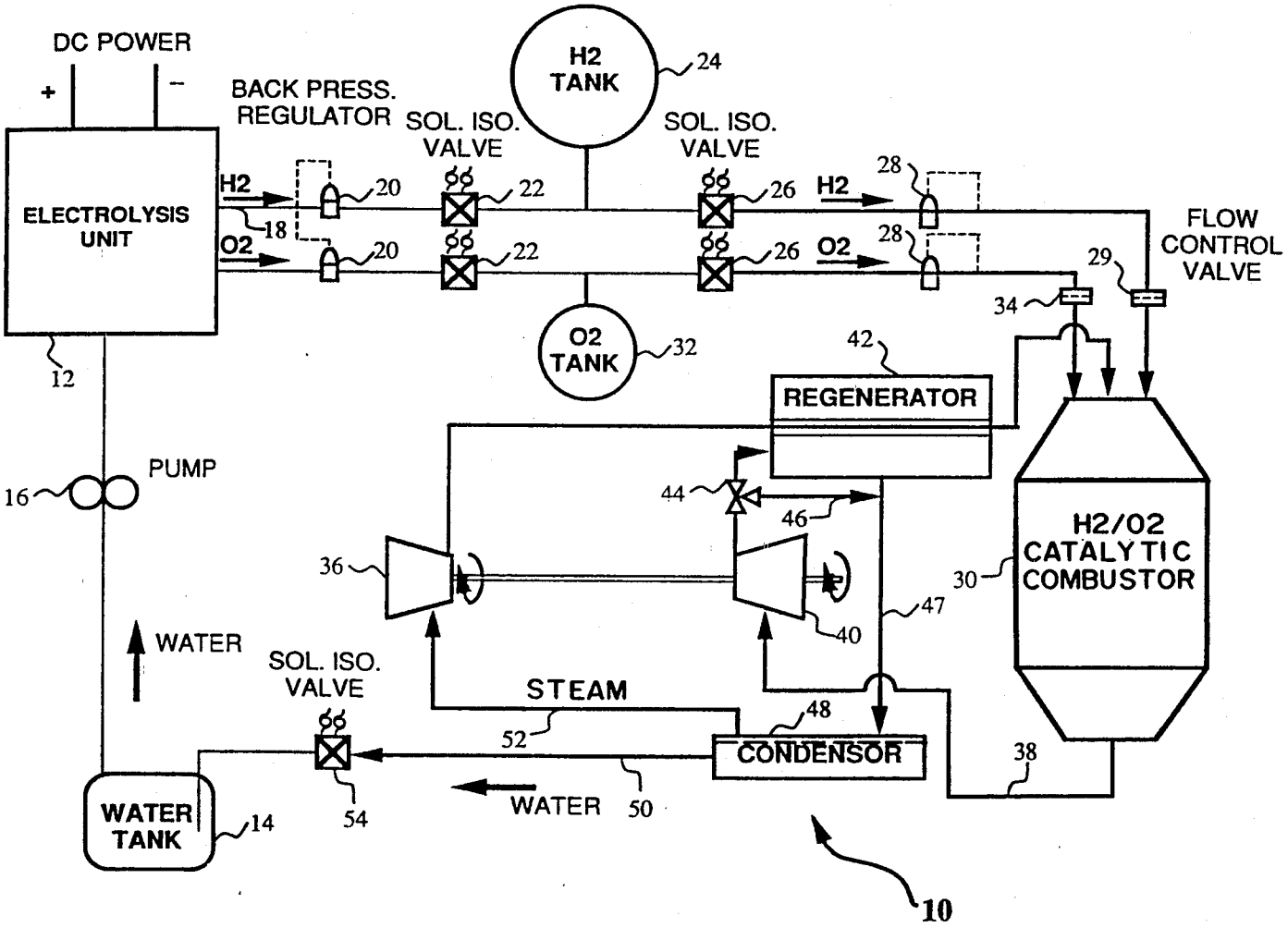
FIG. 1 is a diagrammatic illustration of the closed cycle power conversion system of the present invention.

Referring to the drawings and the characters of reference marked thereon, FIG. 1 illustrates the closed cycle power conversion system of the present invention, designated generally as 10. An electrolysis unit 12 (described in detail below) receives water from a water source 14 via pump 16. Electrolysis unit 12 separates the water into high pressure hydrogen ($H_2$) and oxygen ($O_2$).

The hydrogen is delivered over line 18 through back pressure regulator 20 and solenoid isolator valve 22 to a hydrogen storage tank 24 which can supply pressurized hydrogen on its output line. Pressurized hydrogen is supplied to a catalytic combustor 30 via a second isolator valve 26, back press regulator 28 and flow control valve 29.

An oxygen outlet of the electrolysis unit 12 delivers oxygen to an oxygen storage tank 32 providing pressurized oxygen. Oxygen is fed from tank 32 to the catalytic combustor 30 through a backpressure regulator 28 and flow control valve 34.

As will be explained in detail below, the preferred combustor for use with the present system is a staged combustor of the type having a first combustion stage for combusting a fuel rich mixture of a fuel and an oxidizer and, a plurality of serially positioned secondary combustor stages, downstream from the first stage. The secondary combustion stages receive secondary flows of oxidizer to an increasing mass of combustion efflux. The gradual increase of oxidizer/fuel ratios provides a resultant substantially stoichiometric combustion.

Combustor 30 is designed to operate at the optimum stoichiometric ratio to maximize its thermal efficiency. The combustion efflux from the combustion is introduced to an engine 36, 40, preferably comprising a turbo-compressor unit. The system 10 is designed to accept a constant mass flow 38 of propellant into the turbine inlet. The enthalpy energy into the turbine 40 is controlled by the propellant flow into the combustor cartridges of the combustor.

The high temperature steam efflux from the turbine 40 is then introduced to a regenerator 42 via valve 44. The regenerator 42 preferably includes a counterflow heat exchanger. A failsafe bypass 46 is activated when the temperature of the catalytic combustor 30 becomes too high. The discharge from the regenerator 42 is cooled and introduced to a condenser/radiator 48. The condenser 48 is used to liquefy and capture a controlled portion 50 of the water vapor issuing out of the turbine exhaust.

The controlled portion 50 of the steam which is condensed by condenser 48 is substantially equal to the mass flow input of propellant into the catalytic combustor 30. The remaining steam 52 emerging from the condenser 48 is delivered to the compressor 36. The compressed remaining portion of steam output from the compressor 36 is then introduced into the cold side of the regenerator 42. Its temperature is increased and it is then delivered to the catalytic combustor to serve as a coolant, closing a loop of the subject power cycle, as will be described in detail below.

The condensate 50 from the condenser 48 is directed through a solenoid isolator valve 54, stored in the storage tank 14 and is delivered on demand through the high pressure pump 16 back to the electrolysis unit 12.

Figure 2:
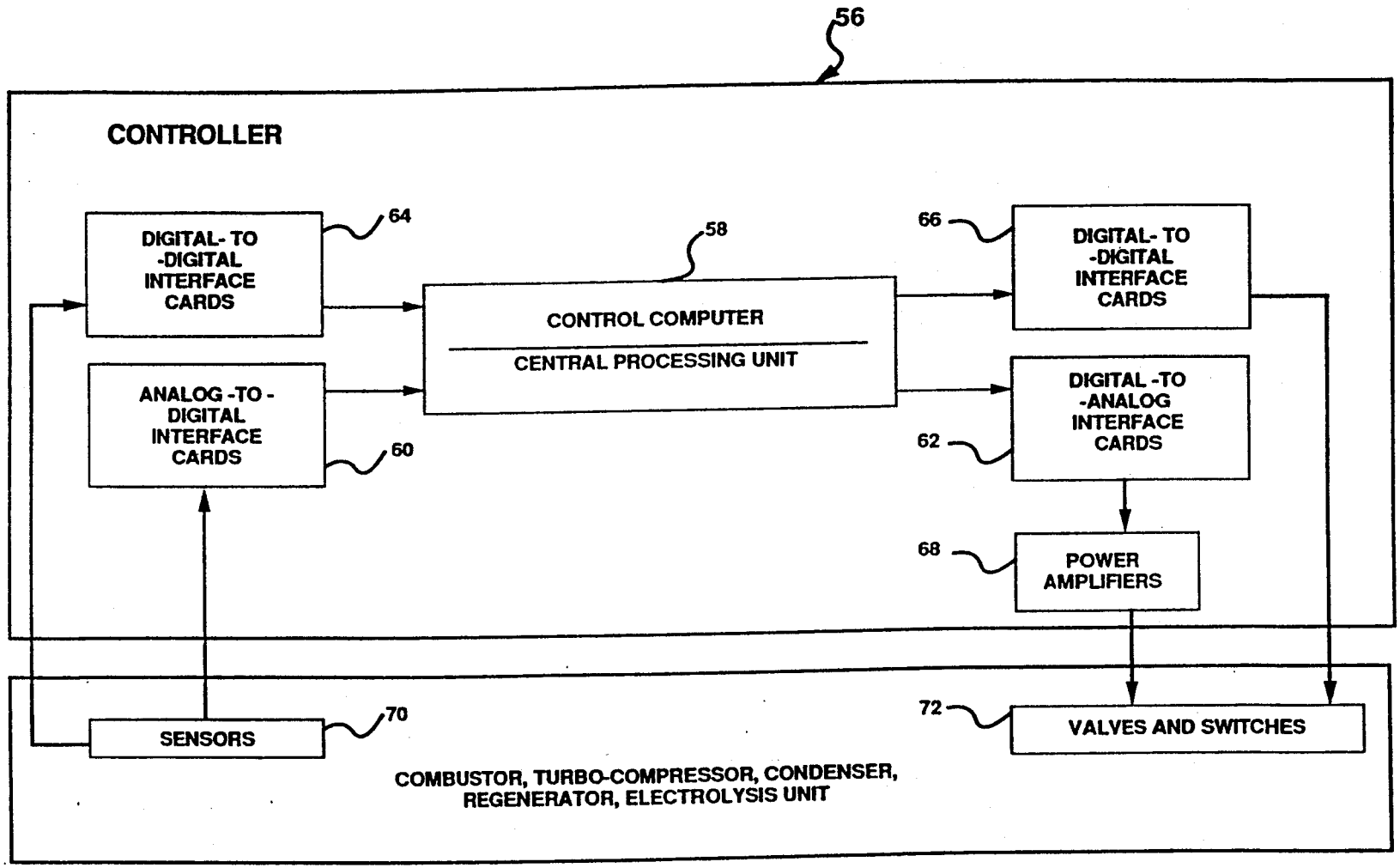
FIG. 2 is a functional block diagram of the controller used for the subject closed cycle power conversion system.

Referring now to FIG. 2, the controller 56 for the present invention comprises a Central Processing Unit 58, analog-to-digital converter input cards 60, digital-to analog converter output cards 62, digital-to-digital input cards 64, digital-to-digital output cards 66, and power amplifier cards 68.

The controller 56 should be operated with at least a 10 Mhz clock rate and with preferably at least 1 mega byte RAM (random access memory). Controller 56 uses a VME bus to internally interface with input/output cards and a VME and/or Ethernet bus to interface with an outside computer for data recording and display.

The digital-to-digital input cards 64 and analog-to-digital input cards 60 acquire feedback information from the various sensors 70 which measure the temperature, pressure, oxygen existence, oxygen flow rate, hydrogen flow rate, steam flow rate, engine speed, coolant flow rate, water level, valve positioning, and other information from various locations within the system 10.

The controller 56, after acquiring sensing signals from the various sensors 70 and comparing these signals with reference signals, will send commands to digital output cards 66 and to digital-to-analog cards 62. The digital output cards 66 then deliver the digital commands to the sensors and control devices 72 that can accept digital commands. The digital-to-analog output cards 62 deliver command signals to the power amplifiers 68 which can deliver sufficient power to drive the actuators of the control devices 72 which use analog signals.

Figure 3A:
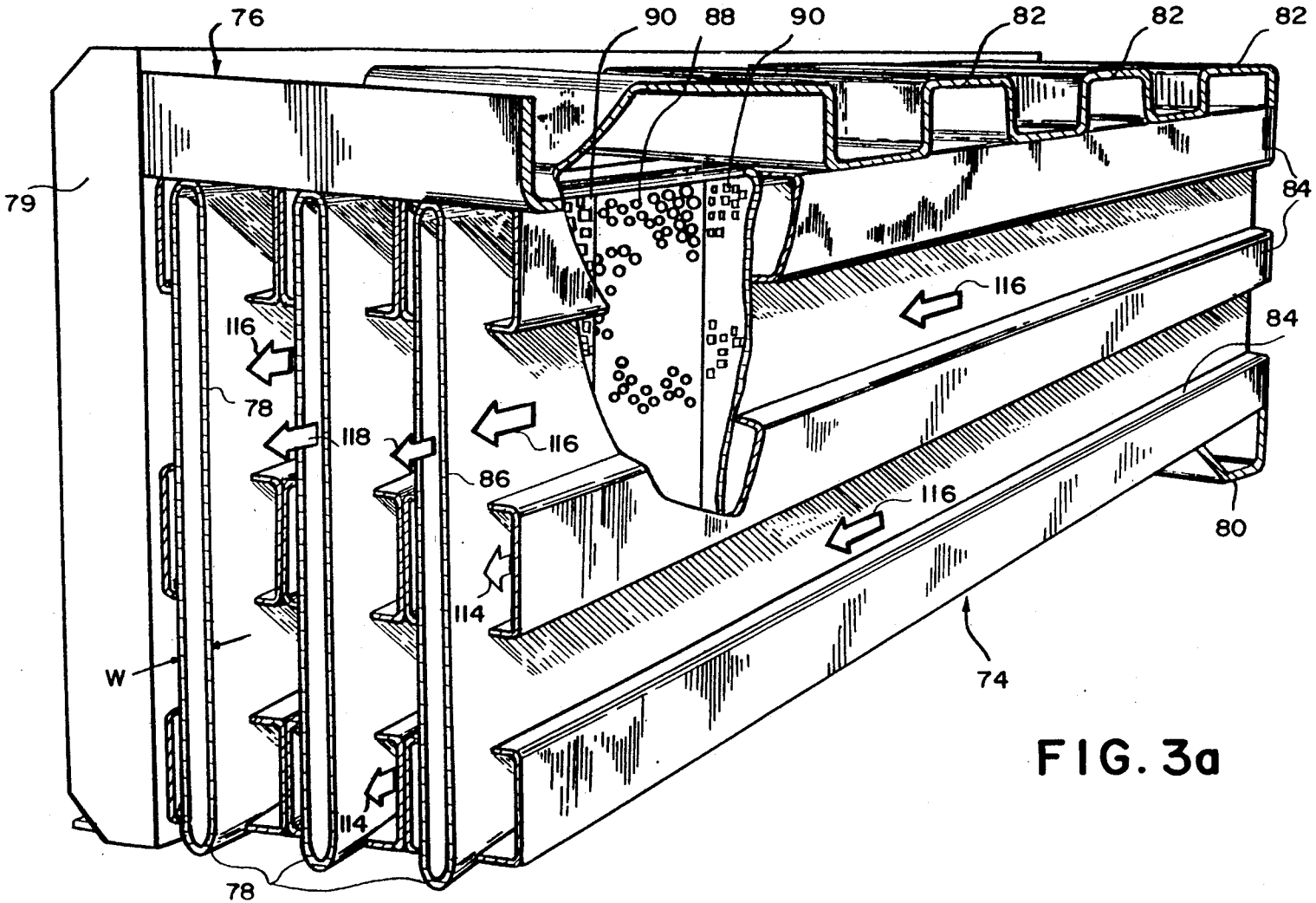
FIG. 3*a* is a rear perspective view of a portion of the catalytic combustor utilized as part of the subject power system.

Referring now to FIG. 3*a* a rear perspective view of a portion of a preferred catalytic combustor is illustrated, designated generally as 74. Catalytic combustor 74 includes a housing 76 having a plurality of parallel, spaced combustor cartridges 78 contained therewithin. (Although FIG. 3*a* illustrates three combustor cartridges, there are fifteen cartridges in the present embodiment. The number of cartridges may vary depending upon the desired level of horsepower.) The combustor 74 includes a rear flange 79 for connection to an output plenum. Housing 76 is formed of a high temperature metal alloy, preferably Inconel.

The bottom of the front portion of the catalytic combustor 74 includes fuel inlet means, i.e. a hydrogen feed plenum 80, which extends along the width of the combustor 74 for supplying $H_2$ to the combustor cartridges 78. The top of the catalytic combustor 74 includes oxidizer inlet means, i.e. axially spaced oxidizer feed plenums 82, for introducing the desired quantity of oxygen to the combustor cartridges 78, as will be described below. Each cartridge 78 preferably includes eight axially spaced compartments and each compartment is directed along an axis perpendicular to the direction of coolant steam flow. Elongated, heat transfer cooling fins 84 are welded to the sidewalls 86 of the combustor cartridges 78. The first compartment of each combustor cartridge 78, at the entrance of the combustor 74, is a mixing chamber (hidden from view in FIG. 3*a*). The second compartment is a catalyst bed compartment (also hidden from view). The third compartment is another mixing chamber which is followed by another catalyst bed compartment and so on. Thus, an alternating series of catalyst bed compartments and mixing chambers are provided along the length of each combustor cartridge 78. In FIG. 3*a*, portions of the cooling fins 84 and sidewall 86 have been cut away to expose a mixing chamber, designated 88 and catalyst bed compartments, designated 90.

Each catalyst bed compartment 90 is packed with a hydrogen oxidizer catalyst such as an activated crushed aluminum oxide ($Al_2O_3$) coated with a precious metal, such as that marketed by Shell Oil Company under the name "SHELL 405". This product uses iridium layered onto aluminum oxide balls and is covered by U.S. Pat. No. 4,124,528.

Each mixing chamber 88 includes granular particles to promote mixing. These particles are preferably nickel based alloys. Other high temperature materials, which are also inert to the hydrogen/oxygen combustion process, may be used. High temperature ceramics such as those that are silica based may be used.

The mixing chamber may contain, for example, the following materials: silica, sand, fused zirconia/silica, fused zirconia/magnesium, carbon chrome steel balls, 440 stainless steel balls or nickel shot.

Figure 3B:
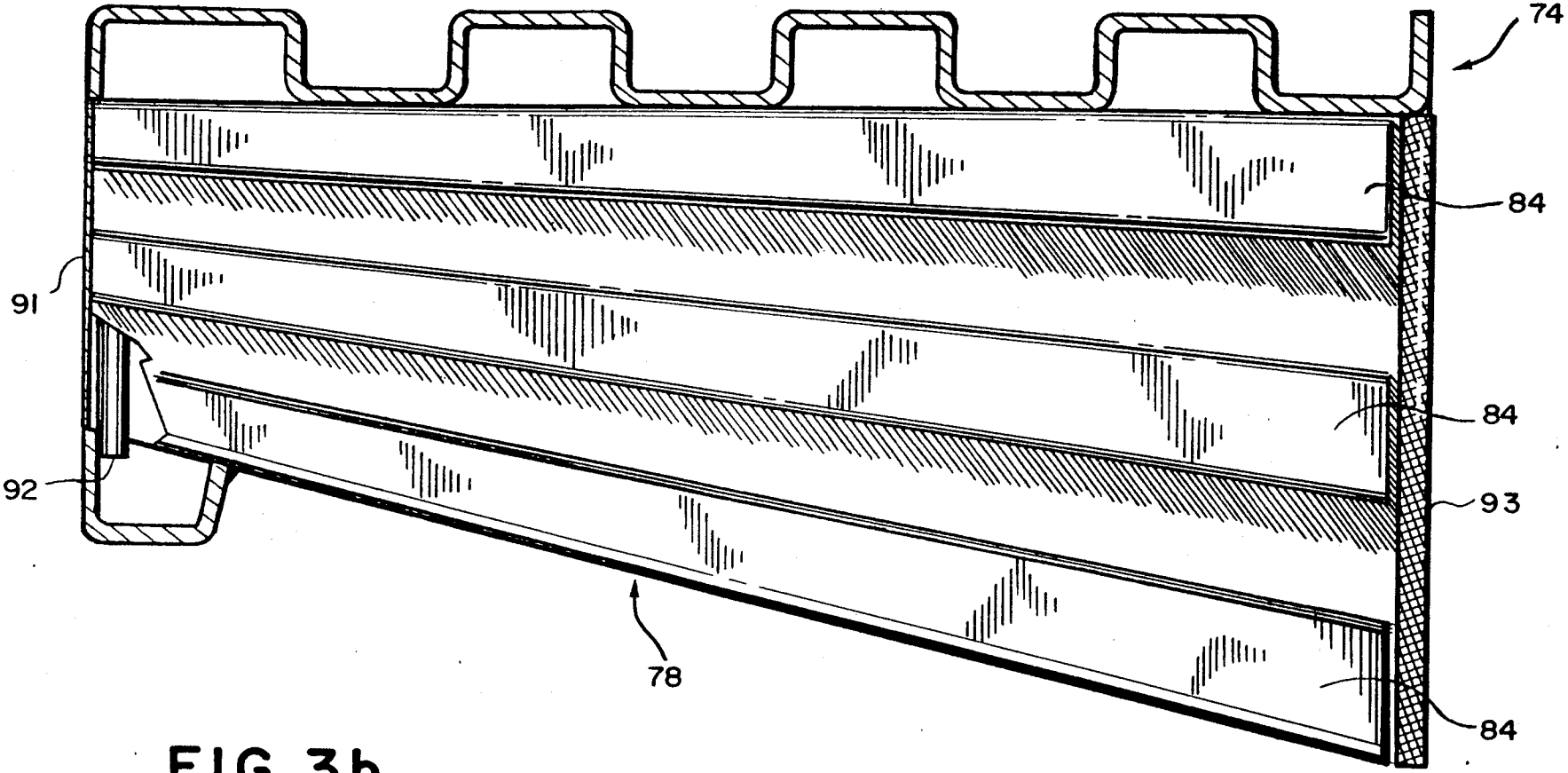
FIG. 3*b* is a side view of the combustor of FIG. 3*a*.

As can be seen by reference to FIG. 3*b* the front edge 91 of each cartridge 78 is closed. However, a hydrogen spray bar 92, extends vertically through the front of each combustor cartridge 78. Thus, hydrogen is released to the front of each of the combustor cartridges 78. The rear end of each cartridge 78 is open so that product steam can flow out and mix with the coolant steam. A screen 93 is spot welded to the rear of the combustor 74 for holding the contents of the combustor cartridge 78 in place.

Figure 3C:
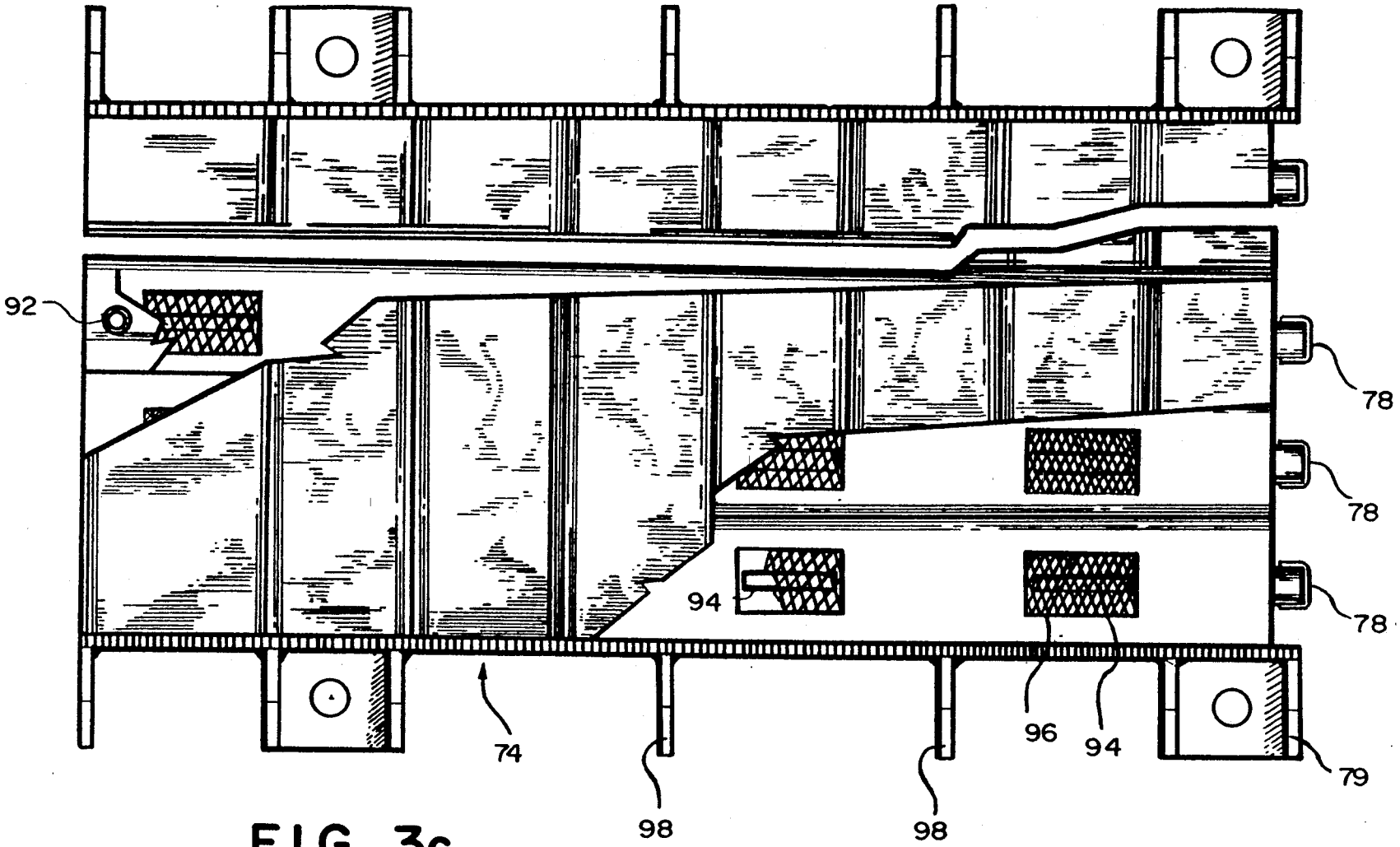
FIG. 3*c* is a top view of the combustor of FIG. 3*a*, partially cut away to expose the oxygen feed slots.

Referring now to FIG. 3*c*, a top view of the combustor 74 is illustrated which is partially cut away to expose oxygen feed slots 94 for providing flows of oxygen to the combustor cartridges 78. This figure also illustrates the use of a stiffener 98 to prevent undesired lateral pressure when the catalytic combustor 74 is pressurized.

A protective screen 96 is provided over each of the oxygen feed slots 94. Each inlet provides a flow of $O_2$ to a respective mixing chamber.

Figure 4:
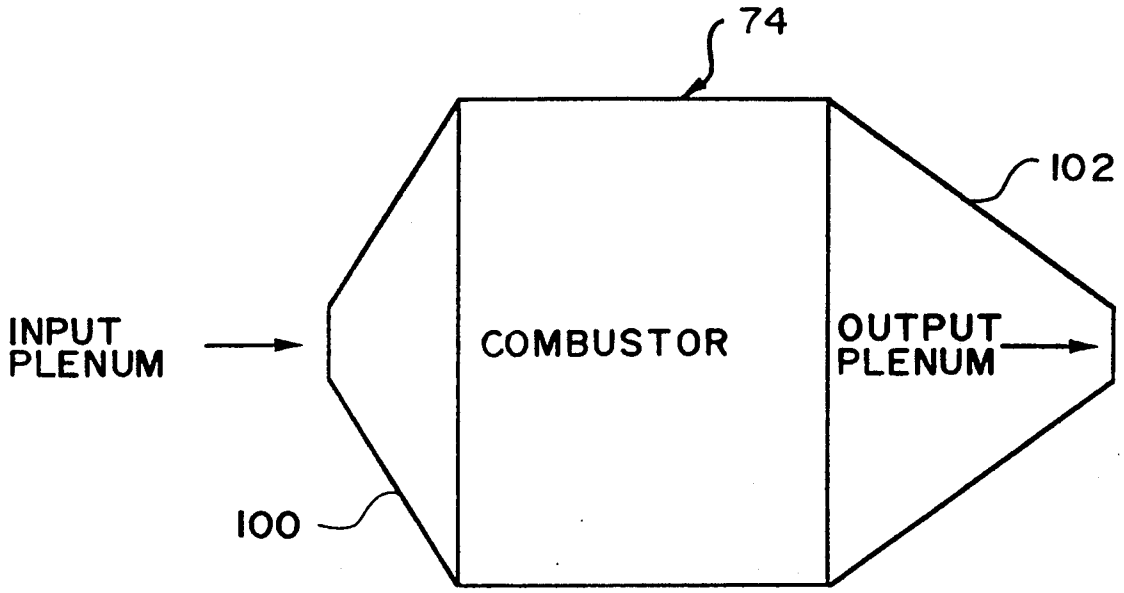
FIG. 4 is a top schematic representation of the combustor, including its input and output plenums.

Referring now to FIG. 4, a schematic top view of the combustor 74 is illustrated. A steam inlet plenum 100 includes an outwardly tapered duct providing flow to the combustion chamber of the combustor 74. A steam outlet 102 to the combustion chamber includes a reverse taper.

As can be readily seen by reference to FIG. 3*b*, the bottom surface of each cartridge 78 is angled to provide an expanding cross sectional area from inlet to outlet. This accommodates the expanding volume of gas in the combustor from front to rear.

Figure 5:
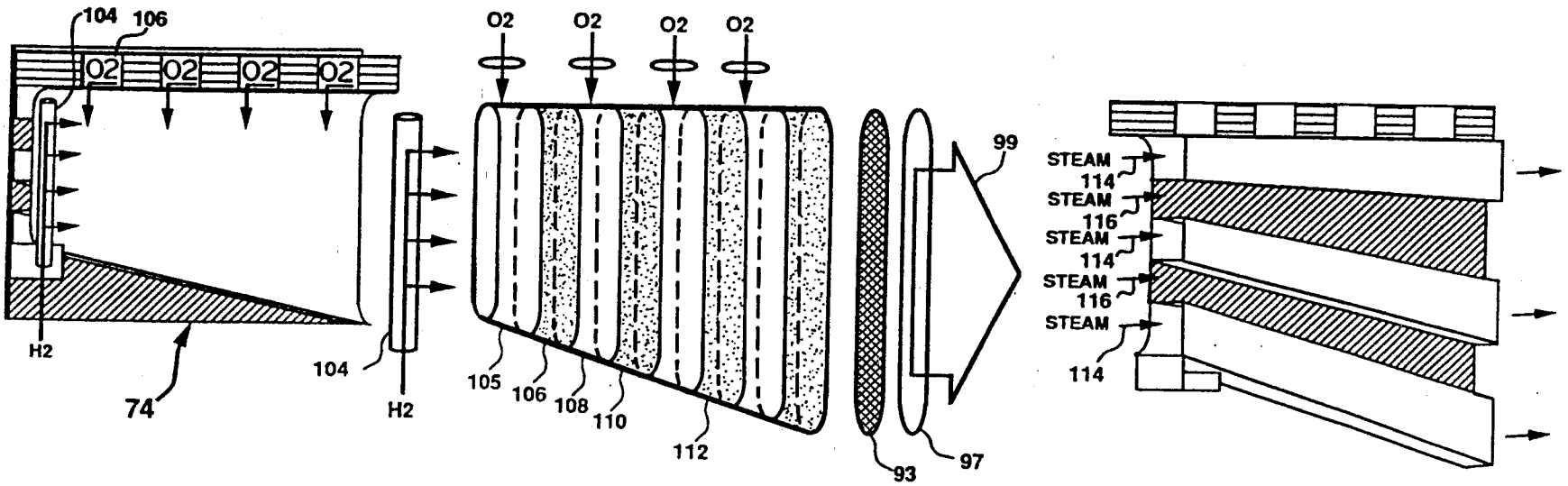
FIG. 5 is a schematic functional diagram of the combustor of the present invention.

Referring now to FIG. 5, a schematic functional diagram of the combustor 74 of the present invention is illustrated. During operation, hydrogen is directed through the hydrogen fuel spray bar 104 into the first mixing chamber 105, where it mixes with oxygen from the first oxygen plenum.

A first quarter of the burn takes place in the first catalyst bed compartment 106. In a second mixing chamber 108, more oxygen is mixed with the fuel rich combustion efflux. A second quarter of the burn takes place in the second catalyst bed compartment 110. Three-quarters of the burn is completed by the third catalyst bed compartment 112. Combustion is complete at the outlet. (Screen 93 and a window frame 97 for retaining the same represent the outlet in this Figure, the resulting combustion efflux being represented by arrow 99.)

Thus, a staged combustion process is provided. The first combustion stage combusts a fuel rich mixture of fuel and oxygen. The serially positioned secondary combustion stages downstream the first stage receive secondary flow of the oxidizer to the increasing mass of combustion efflux. The gradual increase of oxidizer/fuel ratios provide a resultant substantially stoichiometric combustion. The oxidizer to unburned fuel mixture mass ratios commencing with the first catalyst bed chamber are 2/1, 8/3, 4/1 and 8/1, respectively.

This extremely efficient combustion process requires an efficient cooling mechanism. Steam from the regenerator is introduced to the inlet plenum of the combustor. As can be seen in FIG. 3*a*, the steam is directed through the fins 84, as shown by arrows 114. It is also directed between the fins, as shown by arrows 116. However, this steam from the regenerator is kept separate from the combustion products in the combustor cartridges 78 (designated by arrows 118) until the flows reach the output plenum 102 (shown in FIG. 4). The flow of the steam, which originated from the regenerator is also illustrated in the right portion of FIG. 5.

The width W of each cartridge 78 is much less than the spaces defined between each pair of spaced apart cartridges 78. This feature provides enhanced cooling of the cartridges 78. Furthermore, the cross sectional area of each cartridge is much less than the surface area of a side face 86 of the cartridge. Thus, a high rate of heat transfer is established.

The cooling is controlled so that the instantaneous mass flow output of condensate is substantially equal to the instantaneous mass flow input of propellant, and the total accumulated mass flow output of condensate is adjusted to be equal to the accumulated mass flow input of propellant.

Thus, the only outside source of power required to run the power system 10 of the present invention is that needed to run the electrolysis unit 12. The electrolysis process preferably utilized is of the type known as the "solid polymer electrolysis" process. This technology was developed by United Technologies Corporation. United Technologies Corporation has several patents in this area. U.S. Pat. Nos. 4,950,371; 4,729,932; and 4,657,829 which provide disclosures of this technology are hereby incorporated by reference.

Briefly, in such an electrolysis process, an electrolytic cell stack consisting of an acid solid polymer electrolyte is employed to split the condensate water from the steam exhaust, into gaseous hydrogen and oxygen. The process is basically well understood as water electrolysis with the aid of acid electrolyte immobilized in a porous polymer matrix. The conductive electrolyte is capable of achieving several orders of magnitude in ion transport (electric current density) over the familiar laboratory setup of two electrodes immersed in a beaker of water. The solid polymer electrolyte membrane also serves as a separator of the product gases.

Electrical DC power input for the electrolysis unit is preferably provided by microwave transmission means. A rectenna device (rectifying antenna) is used for converting microwave energy into DC power. The power collecting rectenna consists of an array of antenna elements that are individually connected to rectifying diodes and a power combining grid. Each element of the array includes a dipole antenna to absorb the microwave energy, a low pass filter to prevent the re-transmission of generated harmonics, a diode to rectify the microwave energy, and an output filter to smooth the DC output. The DC circuit connections may be in either series or parallel, depending upon the load requirements. Obviously, the lunar or other vehicle, for which the present power cycle is intended, is capable of roving to various locations. To capture maximum incoming rf power independent of the vehicle position or orientation, a scanning capability should be included to track the relative position of the transmitting source. Directional rf sensors could be included to provide the position sensing function. The transmitter for providing the rf microwave power could, for example, utilize a Klystron amplifier which drives a parabolic antenna.

As can be readily understood, although conceived for use with lunar mechanisms, the principles of the present invention may be utilized for terrestrial operations offering significant environmental advantages over presently used internal combustion engines.

Obviously, many modifications and variations of the present invention are possible in light of the above teachings. It is therefore to be understood that, within the scope of the appended claims, the invention may be practiced otherwise than as specifically desribed. For example, although the power system 10 has been described for use with $H_2O$ as the working fluid other fluids may be used, for example hydrogen peroxide. What is imperative is that the combustion efflux be combinable with a third product to form a working fluid, the third product having the same atomic and molecular constituents as the fuel and the oxidizer.

What is claimed and desired to be secured by Letters Patent of the United States is:

1. A closed cycle power system, comprising:

a) means for combusting a fuel and an oxidizer at stoichiometric conditions;

b) means for combining the resulting combustion efflux with a third product to form a working fluid, said third product having the same atomic constitutents as said fuel and said oxidizer;

c) an engine for receiving said working fluid and providing power output therefrom;

d) means for cooling an exhaust from said engine and extracting and condensing a controlled portion of said exhaust;

e) separating means for separating said controlled portion into its original atomic constitutents for storage under high pressure and ultimate reuse as said fuel and oxidizer; and, f) means for recompressing and reheating the remaining portion of said exhaust, said remaining portion being said third product, the resulting stoichiometric closed loop process providing an efficient source of power.

2. The closed cycle power system of Claim 1, wherein:

said means for combusting a fuel and an oxidizer includes means for combusting $H_2$ and $O_2$, and said means for combining the resulting combustion efflux with a third product includes combining said combustion efflux with $H_2O$.

3. The closed cycle power system of Claim 2, wherein:

said separating means for separating said controlled portion into its original atomic and molecular constituents includes means for converting water to $H_2$ and $O_2$.

4. The closed cycle power system of claim 3, wherein:

said means for converting water to $H_2$ and $O_2$ includes solid polymer electrolysis means.

5. The closed cycle power system of Claim 4, further including:

microwave transmission means for providing electrical dc power input for said solid polymer electrolysis means.

6. The closed cycle power system of Claim 2, wherein:

said engine includes a turbo-compressor.

7. The closed cycle power system of Claim 6, wherein said means for recompressing and reheating the remaining portion of said exhaust includes:

a compressor of said turbo-compressor for receiving said remaining portion, and heat exchanger means for receiving the fluid output of said compressor and raising its pressure and its temperature to an acceptable value for use as said third product.

8. The closed cycle power system of Claim 7, wherein said heat exchanger means includes a heat exchanger for receiving the fluid output of said compressor.

9. A combustion process, comprising:

a) combusting a fuel and an oxidizer at stoichiometric conditions;

b) combining the resulting combustion efflux with a third product to form a working fluid, said third product having the same atomic constituents as said fuel and said oxidizer;

c) introducing said working fluid into an engine, said engine for providing power output;

d) cooling the exhaust from said engine and extracting and condensing a controlled portion of said exhaust;

e) separating said controlled portion into its original atomic constituents for storage and under high pressure and ultimate reuse as said fuel and oxidizer; and, f) recompressing and reheating the remaining portion of said exhaust, said remaining portion being said third product, the resulting stoichiometric closed loop process providing an efficient source of power.

10. The combustion process of claim 9, wherein:

said step combus ting a fuel and an oxidizer includes combusting $H_2$ and $O_2$ and, said step of combining the resulting combustion efflux with a third product includes combining said combustion efflux with $H_2O$.

11. The combustion process of claim 10, wherein:

said step of separating said controlled portion includes converting water to $H_2$ and $O_2$.

12. The combustion process of claim 11, wherein said conversion includes a solid polymer electrolysis process.

13. The combustion process of claim 12, further including the step of providing electrical dc power input for said solid polymer electrolysis process by microwave transmission thereto.

14. The combustion process of claim 10, wherein said step of introducing the resulting combustion efflux into an engine includes the step of introducing said combustion efflux into a turbo-compressor.

15. The combustion process of claim 14, wherein said step of recompressing and reheating the remaining portion of said exhaust includes the steps of:

introducing said remaining portion to a compressor of said turbo-compressor; and, directing the fluid output of said compressor to heat exchanger means for raising its pressure and its temperature to an acceptable value for use as said third product.

16. The combustion process of claim 15, wherein said step of directing the fluid output of said compressor to heat exchanges means includes the introduction thereof to a heat exchanger.

* * * * *